US007586696B2

(12) United States Patent
Wu

(10) Patent No.: US 7,586,696 B2
(45) Date of Patent: Sep. 8, 2009

(54) APPARATUS FOR ASSEMBLING LENSES

(75) Inventor: Cheng-Shiun Wu, Taipei Hsien (TW)

(73) Assignee: Hon Hai Precision Co., Ltd., Tu-Cheng, Taipei Hsien (TW)

( * ) Notice: Subject to any disclaimer, the term of this patent is extended or adjusted under 35 U.S.C. 154(b) by 283 days.

(21) Appl. No.: 11/556,383

(22) Filed: Nov. 3, 2006

(65) Prior Publication Data

US 2007/0237621 A1 Oct. 11, 2007

(30) Foreign Application Priority Data

Apr. 5, 2006 (CN) ..... 2006 1 0060179

(51) Int. Cl.
*G02B 7/02* (2006.01)

(52) U.S. Cl. ..... 359/819

(58) Field of Classification Search ..... 359/808–819, 359/619, 821–822

See application file for complete search history.

(56) References Cited

U.S. PATENT DOCUMENTS 5,996,792 A * 12/1999 Alvaro et al. ..... 206/454
2006/0006091 A1* 1/2006 Maietta ..... 206/539

FOREIGN PATENT DOCUMENTS

CN 2684232 Y 3/2005

* cited by examiner

*Primary Examiner*—Ricky L Mack
*Assistant Examiner*—Vipin M Patel
(74) *Attorney, Agent, or Firm*—Frank R. Niranjan

(57) ABSTRACT

An apparatus for assembling lenses includes a lens tray, a support and a tray-securing member. The lens tray defines a plurality of lens-receiving holes configured for receiving lenses and a plurality of positioning holes defined therein. The support is configured for supporting the lens tray and defines a plurality of positioning pins thereon configured for extending through the corresponding positioning holes of the lens tray. The tray-securing member includes a pressing portion defining a through hole therein and a plurality of sleeves configured for receiving the positioning pins therein. The pressing portion is configured for downwardly pressing the lens tray to prevent the lens tray from shaking.

18 Claims, 5 Drawing Sheets

APPARATUS FOR ASSEMBLING LENSES

TECHNICAL FIELD

The present invention relates to apparatuses for assembling lenses and, more particularly, to an apparatus for assembling lenses incorporating a tray-securing member.

BACKGROUND

An automatic assembly line for lens modules may use, for example, a robotic arm to pick up (e.g., by suction, claw or otherwise) lens elements from a lens holder such as a lens tray, and to assemble them into a lens barrel. It is important and often critical to know a precise location and orientation of each lens element, so that the robotic arm can pick up the lens elements from the lens tray. If a lens element shifts and changes its position on the lens tray, and if the lens element is picked up by suction, the amount of suction may not be enough to successfully pick up the lens element.

FIG. 5 illustrates a conventional apparatus for assembling lenses. The apparatus 100 includes a lens tray 10, a support 12 and two positioning pins 14. The lens tray 10 defines a plurality of lens-receiving holes 102 for receiving lens elements and two positioning holes 104. The lens-receiving holes 102 are arranged in a matrix array on one surface of the lens tray 10 and the two positioning holes 104 are defined at two across corners of the lens tray 10. The positioning pins 14 are fixed on the support 12 and correspond to the two positioning holes 104 separately. In use, the two positioning pins 14 extend through the positioning holes 104 and thus the lens tray 10 is located on the support 12.

However, the lens tray 10 may be shaken by accidental contact with a foreign object. The shaking of the lens tray 10 may cause the lens elements received in the lens-receiving holes 102 to change their position. In order to assemble them accurately, the positions must be readjusted, thus wasting time, thereby reducing efficiency.

What is needed, therefore, is to provide an apparatus for assembling lenses that can prevent the lens tray from shaking.

SUMMARY

In a preferred embodiment of the present invention, an apparatus for assembling lenses includes a lens tray, a support and a tray-securing member. The lens tray defines a plurality of lens-receiving holes configured for receiving lenses and a plurality of positioning holes defined therein. The support is configured for supporting the lens tray and defines a plurality of positioning pins thereon configured for extending through the corresponding positioning holes of the lens tray. The tray-securing member includes a pressing portion defining a through hole therein and a plurality of sleeves configured for receiving the positioning pins therein. The pressing portion is configured for downwardly pressing the lens tray to prevent the lens tray from shaking. Additionally, the pressing portion defines a through hole configured for exposing the lens-receiving holes of the lens tray to an exterior.

Advantages and novel features will become more apparent from the following detailed description of the present assembly apparatus for lens modules, when taken in conjunction with the accompanying drawings.

BRIEF DESCRIPTION OF THE DRAWINGS

Many aspects of the present apparatus for assembling lenses can be better understood with reference to the following drawings. The components in the drawings are not necessarily drawn to scale, the emphasis instead being placed upon clearly illustrating the principles of the present apparatus for assembling lenses. Moreover, in the drawings, like reference numerals designate corresponding parts throughout the several views.

DETAILED DESCRIPTION OF PREFERRED EMBODIMENTS

Reference will now be made to the drawings to describe preferred embodiments of the apparatus for assembling lenses.

Figure 1:
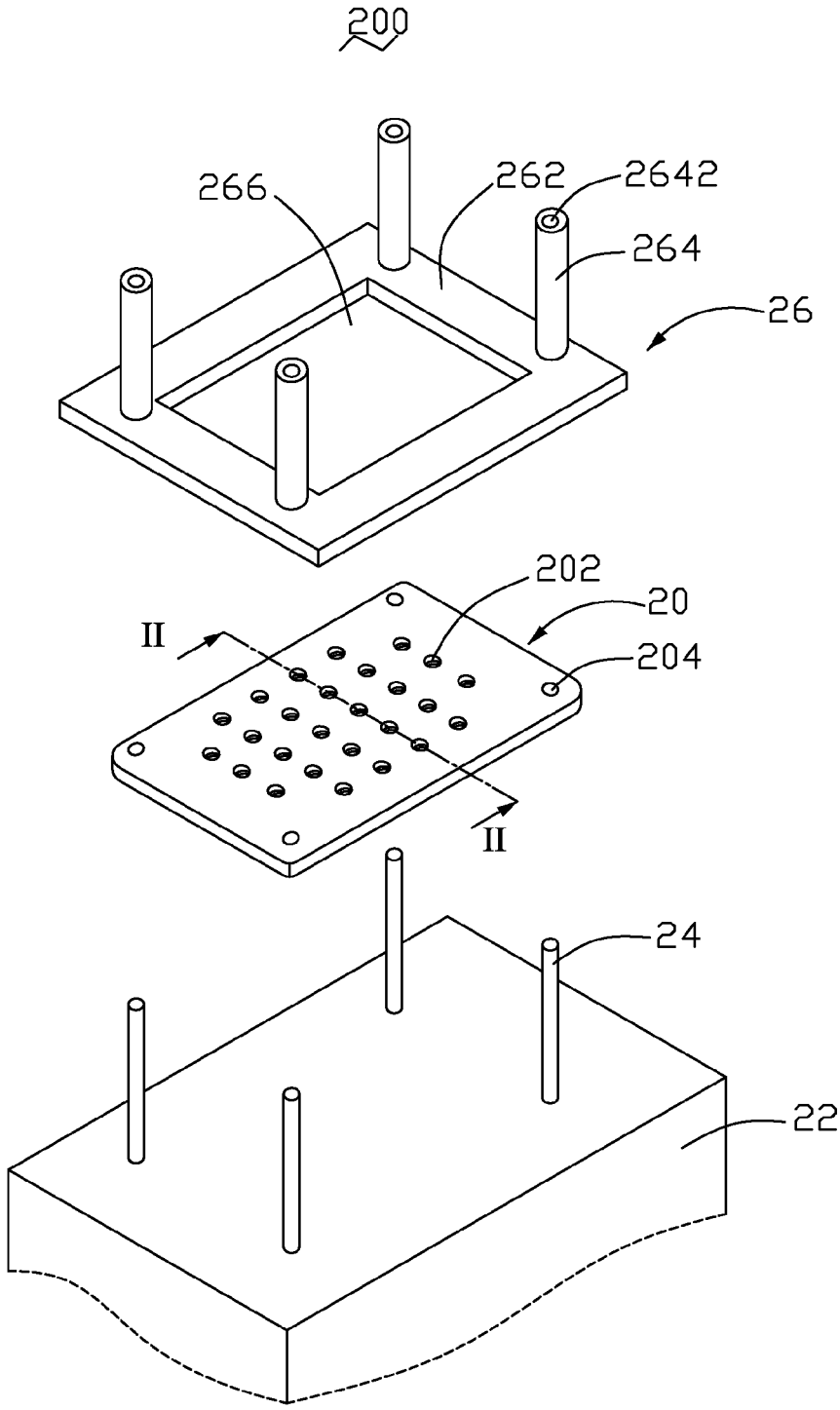
FIG. 1 is a schematic, exploded isometric view of an apparatus for assembling lenses in accordance with a preferred embodiment, the apparatus including a lens tray.

FIG. 1 illustrates an apparatus 200 for assembling lenses in accordance with a preferred embodiment. The assembling apparatus 200 can be used for assembling process of lens modules and includes a lens tray 20, a support 22, a plurality of positioning pins 24 and a tray-securing member 26.

The lens tray 20 includes a plurality of lens-receiving holes 202 defined therein. The lens-receiving holes 202 are arranged in a matrix array and are used for receiving lens elements such as, for example, optical lenses, infra-red filters, lens barrels etc. Generally, the lens tray 20 is rectangle-shaped. The lens tray 20 defines a plurality of positioning holes 204 therein, the number of which is same as the positioning pins 24. According to this preferred embodiment, the lens tray 20 defines four positioning holes 204 adjacent to the four corners thereof.

The support 22 is used for supporting the lens tray 20. Four positioning pins 24 are attached on or integrally formed with the support 22, and are positioned corresponding to the four positioning holes 204. The four positioning pins 24 penetrate through the positioning holes 204 and thus the lens tray 20 is located on the support 22. Specially, the positioning pins 24 are configured for extending through the positioning holes 204.

The tray-securing member 26 includes a pressing portion 262 and four sleeves 264 and is configured for mounting on the lens tray 20. The sleeves 264 are attached on the pressing portion 262 or integrally formed with the pressing portion 262. Each of the sleeves 264 defines a first through hole 2642 therein and the first through hole 2642 extends through the pressing portion 262. The pressing portion 262 is a pressing plate defining a second through hole 266 therein. The second through hole 266 is configured for exposing the lens-receiving holes 202 of the lens tray 20 to an exterior. The pressing portion 262 is disposed on the lens tray 20 and contacts the lens tray 20 on the four edges thereof. The positioning pins 24 are inserted in the four sleeves 264. The pressing portion 262 can be selected from a high mass density material consisting of metal, alloy etc. in order to press the lens tray 20 firmly. The metal can be selected from the group consisting of copper, iron etc. The alloy can be selected from the group consisting of copper alloys, iron alloys etc. Preferably, the pressing portion 262 is stainless steel.

Figure 2:
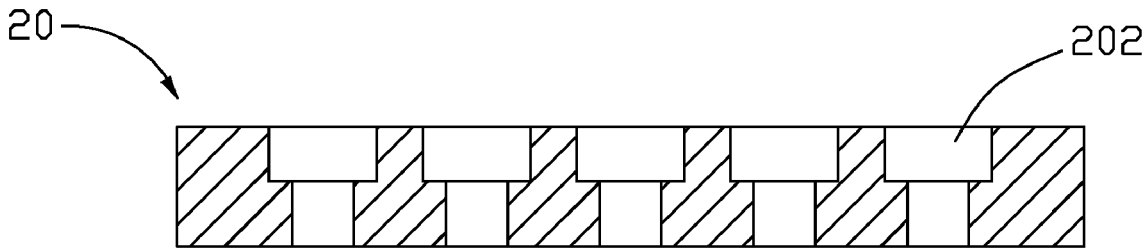
FIG. 2 is a schematic, cross-sectional view of the lens tray, taken along line II-II of FIG. 1.
Figure 3:
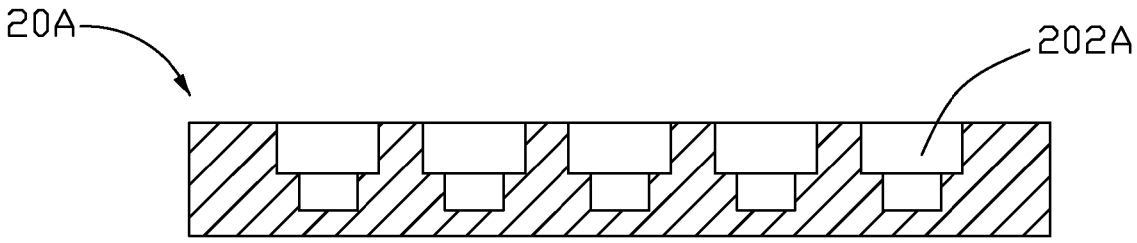
FIG. 3 is a schematic, cross-sectional view of another embodiment of the lens tray of FIG. 1.

FIGS. 2 and 3 illustrate two preferred configurations of the lens tray in accordance with the preferred embodiment. In FIG. 2, each of the lens-receiving holes 202 is a through hole that is a stepped structure defined in the lens tray 20. In FIG. 3, an alternative lens tray 20A is shown. Each of lens-receiving holes 202A is a groove that has a stepped structure defined in the lens tray 20A. These two lens trays 20 and 20A can be used with different lens elements in various ways, for example, the lens tray 20 can be used with optical lenses and the lens trays 20A can be used with lens barrels.

The present apparatus 200 assembling lenses includes a tray-securing member 26, which can prevent the lens tray 20 from shaking because of depressing of the pressing portion 262 with high mass density.

Figure 4:
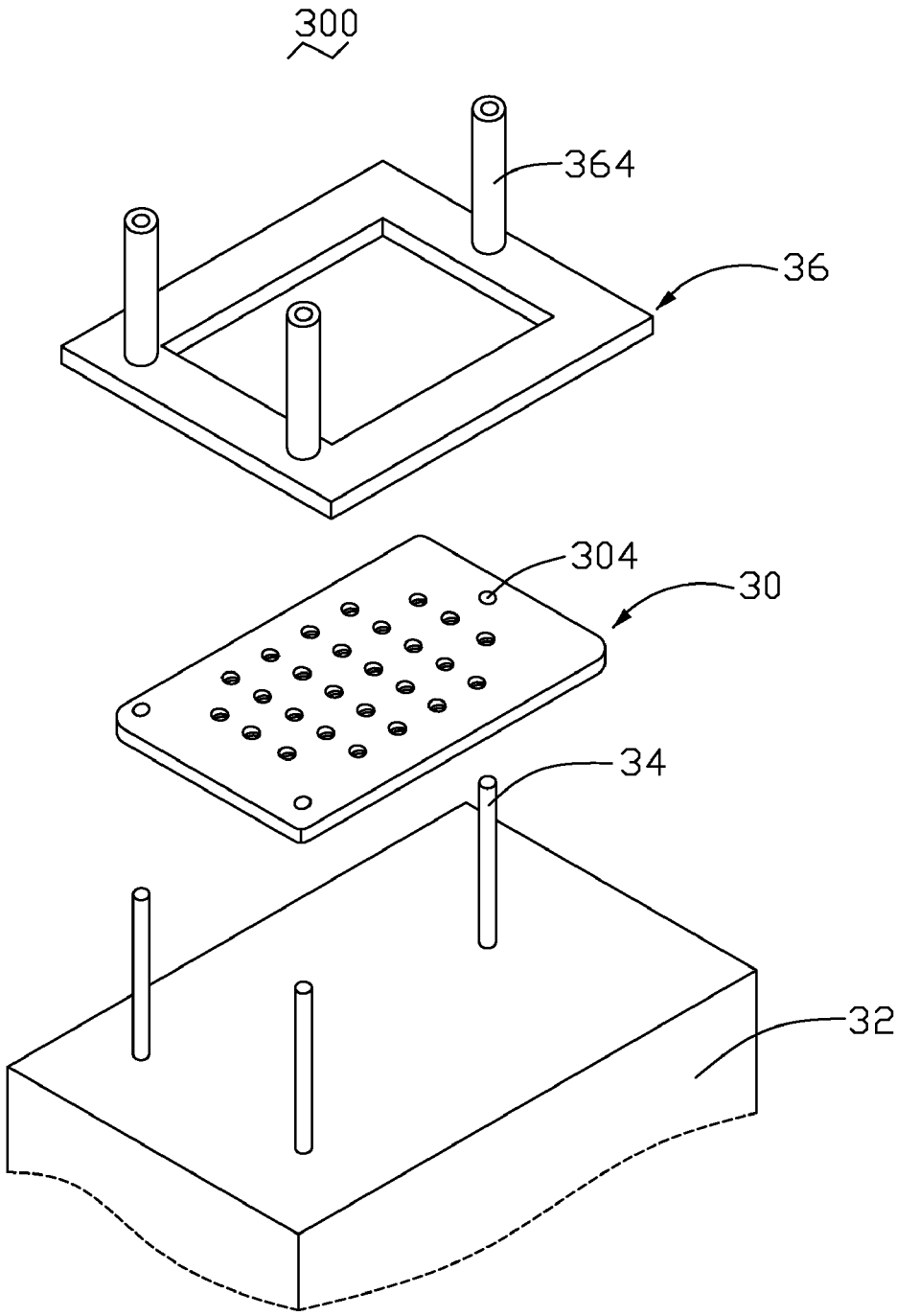
FIG. 4 is a schematic, exploded isometric view of an apparatus for assembling lenses in accordance with another preferred embodiment.
Figure 5:
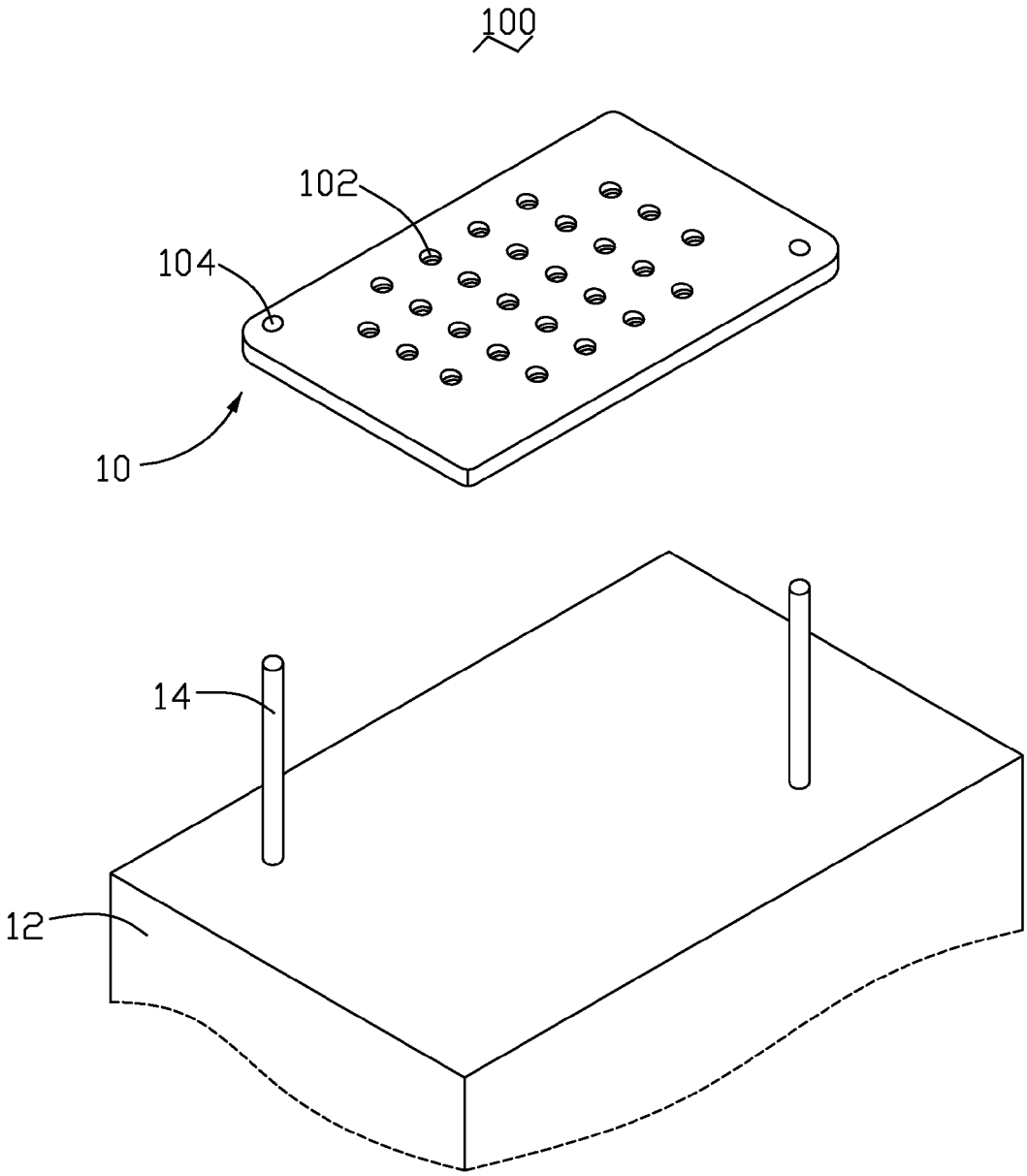
FIG. 5 (RELATED ART)
FIG. 5 is a schematic, exploded isometric view of a conventional apparatus for assembling lenses.

Referring to FIG. 4, an apparatus 300 for assembling lenses is illustrated in accordance with another embodiment. The apparatus 300 includes a lens tray 30, a support 32 and a tray-securing member 36. The assembling apparatus 300 is similar to the assembling apparatus 200, and the difference is that there are three of each of the positioning holes 304 defined in the lens tray 30, the positioning pins 34 and the sleeves 364 according to the positioning holes 304. The three positioning holes 304 are arranged on the two opposite edges of the lens tray 30, one of which is in the middle of one edge and another two are at two ends of the other edge.

It is to be understood that the amount of positioning holes defined in the lens tray also can be of different amounts. Additionally, each of the sleeves 264 and 364 can cover one open end and materials of which can be same as the pressing portion 262 or 362.

It is to be understood that the above-described embodiment is intended to illustrate rather than limit the invention. Variations may be made to the embodiment without departing from the spirit of the invention as claimed. The above-described embodiments are intended to illustrate the scope of the invention and not restrict the scope of the invention.

What is claimed is:

1. An apparatus for assembling lenses, comprising:

a lens tray defining a plurality of lens-receiving holes configured for receiving lenses therein and a plurality of positioning holes therein;

a support configured for supporting the lens tray, the support defining a plurality of positioning pins thereon configured for extending through the corresponding positioning holes of the lens tray;

a tray-securing member comprising a pressing portion defining a first through hole therein configured for exposing the lens-receiving holes of the lens tray to an exterior, and a plurality of sleeves, the pressing portion and the plurality of sleeves cooperatively defining a plurality of second through holes, each of the second through holes spanning through the pressing portion and at least part of a respective one of the sleeves and configured for receiving a respective one of the positioning pins therein, the pressing portion being configured for downwardly pressing the lens tray to prevent the lens tray from shaking.

2. The apparatus as claimed in claim 1, wherein the positioning pins are attached on or integrally formed with the support.

3. The apparatus as claimed in claim 1, wherein the sleeves are attached on or integrally formed with the pressing portion.

4. The apparatus as claimed in claim 1, wherein a material of the pressing portion is selected from the group consisting of metal and alloy.

5. The apparatus as claimed in claim 4, wherein the metal is selected from the group consisting of copper and iron, and the alloy is selected from the group consisting of copper alloy and iron alloy.

6. The apparatus as claimed in claim 5, wherein the iron alloy comprises stainless steel.

7. The apparatus as claimed in claim 1, wherein there are four positioning holes arranged adjacent to four corners of the lens tray.

8. The apparatus as claimed in claim 1, wherein there are three positioning holes arranged on the lens tray, one of which is in the middle of one edge and another two are at two ends of the other edge.

9. The apparatus as claimed in claim 1, wherein each of the lens-receiving holes is a stepped through hole.

10. An apparatus for assembling lenses, comprising:

a support with a plurality of positioning pins defined thereon;

a lens tray having a plurality of lens-receiving holes and a plurality of positioning holes therein, the lens tray being configured for mounting on the support with the positioning pins extending through the positioning holes thereof; and a tray-securing member having a pressing portion and a plurality of separate sleeves formed on the pressing portion, each of the plurality of sleeves defining a first through hole that also extends through the pressing portion, the tray-securing member being configured for mounting on the lens tray with the pressing portion thereof depressing the lens tray and the positioning pins of the support inserted in the first through holes of the sleeves thereof, the pressing portion defining a second through hole configured for exposing the lens-receiving holes of the lens tray to an exterior.

11. The apparatus as claimed in claim 10, wherein the positioning pins are selectively at least one of attached on the support and integrally formed with the support.

12. The apparatus as claimed in claim 10, wherein there are three positioning holes in the lens tray, one of which is in the middle of one edge of the lens tray, and the other two of which are at two ends of another edge of the lens tray.

13. The apparatus as claimed in claim 10, wherein there are four positioning holes arranged adjacent to four corners of the lens tray.

14. An apparatus for assembling lenses, the apparatus comprising:

a support with a plurality of positioning pins extending therefrom;

a lens tray having a plurality of lens-receiving holes and a plurality of positioning holes therein, the lens tray being configured for mounting on the support with the positioning pins extending through the positioning holes; and a tray-securing member having a pressing portion and a plurality of discrete sleeves formed on the pressing portion, the pressing portion having a first surface and a second surface at opposite sides thereof, the first surface contacting the lens tray, the sleeves being formed on the second surface, each of the sleeves defining a first through hole that also extends through the pressing portion, the pressing portion of the tray-securing member being configured for depressing the lens tray with the positioning pins of the support received in the first through holes of the sleeves, respectively, the pressing portion defining a second through hole configured for exposing the lens-receiving holes of the lens tray to an exterior.

15. The apparatus as claimed in claim 14, wherein the positioning pins are selectively at least one of attached on the support and integrally formed with the support.

16. The apparatus as claimed in claim 14, wherein the sleeves are selectively at least one of attached on the pressing portion and integrally formed with the pressing portion.

17. The apparatus as claimed in claim 14, wherein there are three positioning holes in the lens tray, one of which is in the middle of one edge of the lens tray, and the other two of which are at two ends of another edge of the lens tray.

18. The apparatus as claimed in claim 14, wherein there are four positioning holes arranged adjacent to four comers of the lens tray.

* * * * *